US008342321B2

(12) United States Patent
McAllan

(10) Patent No.: US 8,342,321 B2
(45) Date of Patent: Jan. 1, 2013

(54) TOILET BRUSH AND HOLDER

(75) Inventor: Neil McAllan, Aberdeen (GB)

(73) Assignee: McAllan Innovations Limited, Banchory-Devenick (GB)

( * ) Notice: Subject to any disclaimer, the term of this patent is extended or adjusted under 35 U.S.C. 154(b) by 141 days.

(21) Appl. No.: 12/526,505

(22) PCT Filed: Feb. 12, 2008

(86) PCT No.: PCT/GB2008/000489

§ 371 (c)(1),
(2), (4) Date: Mar. 22, 2011

(87) PCT Pub. No.: WO2008/099164

PCT Pub. Date: Aug. 21, 2008

(65) Prior Publication Data

US 2011/0162988 A1 Jul. 7, 2011

(30) Foreign Application Priority Data

Feb. 13, 2007 (GB) ..... 0702702.2

(51) Int. Cl.
*A45D 44/18* (2006.01)

(52) U.S. Cl. ..... 206/15.3; 206/362.3; 401/127; 401/129

(58) Field of Classification Search ..... 206/362.3, 206/15.3, 15.2, 361, 209; 401/127, 129; 15/180; 4/255.11
See application file for complete search history.

(56) References Cited

U.S. PATENT DOCUMENTS 578,780 A * 3/1897 Smith ..... 401/127
580,013 A * 4/1897 Smith ..... 401/121
2,138,319 A * 11/1938 Bilbrey ..... 401/127
4,211,750 A * 7/1980 Gillespie ..... 422/123
4,717,032 A * 1/1988 Wu ..... 215/228
4,776,456 A * 10/1988 Lewis ..... 206/15.3
5,690,441 A * 11/1997 McManus ..... 401/127
5,727,280 A 3/1998 Romano
6,035,456 A * 3/2000 Taylor ..... 4/255.11

(Continued)

FOREIGN PATENT DOCUMENTS

DE 202 01 635.8 7/2002

(Continued)

OTHER PUBLICATIONS

International Search Report for International Application No. PCT/GB2008/000489 (Jun. 4, 2009).

(Continued)

*Primary Examiner* — David Fidei
(74) *Attorney, Agent, or Firm* — Jenkins, Wilson, Taylor & Hunt, P.A.

(57) ABSTRACT

The present invention relates to a toilet brush (1) and holder (10). The toilet brush (1) comprises a handle (2) and a brush head. The holder (10) comprises a container (11C) configured to hold disinfectant liquid. The holder (10) is configured: to support the toilet brush and bear the weight of the toilet brush in a first position, in which the brush head is spaced apart from liquid in the container; and to support the toilet brush in a second position, in which the brush head is at least partially immersed in liquid in the container. The holder (10) is configured for movement of the toilet brush (1) between the first and second positions by a user.

19 Claims, 4 Drawing Sheets

U.S. PATENT DOCUMENTS

| | | | | |
|---|---|---|---|---|
| 6,050,401 | A * | 4/2000 | Michaelson | 206/225 |
| 6,926,137 | B2 * | 8/2005 | Rudnick et al. | 206/15.3 |
| 8,167,123 | B2 * | 5/2012 | Lai | 206/15.3 |
| 2004/0262171 | A1 * | 12/2004 | Lai | 206/15.3 |
| 2006/0213792 | A1 * | 9/2006 | Nguyen et al. | 206/349 |
| 2008/0135433 | A1 * | 6/2008 | Weis et al. | 206/362.2 |
| 2008/0156680 | A1 * | 7/2008 | Lai | 206/361 |
| 2010/0314272 | A1 * | 12/2010 | Jurgens et al. | 206/361 |
| 2012/0012136 | A1 * | 1/2012 | Nguyen et al. | 134/22.12 |

FOREIGN PATENT DOCUMENTS

| | | | |
|---|---|---|---|
| GB | 510900 | A | 8/1939 |
| GB | 848 828 | | 9/1960 |
| GB | 848 828 | A | 9/1960 |
| WO | WO 99/23926 | | 5/1999 |
| WO | WO 99/23926 | A | 5/1999 |

OTHER PUBLICATIONS

Notification Concerning Transmittal of International Preliminary Report on Patentability for International Application No. PCT/GB2008/000489 (Aug. 19, 2009).

Search Report under Section 17 for Application No. GB0702702.2 (Aug. 20, 2007).

* cited by examiner

TOILET BRUSH AND HOLDER

FIELD OF INVENTION

The present invention relates to a toilet brush and holder.

BACKGROUND TO INVENTION

The toilet brush and holder is known. Forms of the known toilet brush and holder have a container for holding disinfectant liquid; when the brush is supported on the holder the brush head is immersed in the disinfectant. GB 510900 and DE 20201635 each describe such a form of toilet brush and holder.

STATEMENT OF INVENTION

The present inventor has appreciated known toilet brushes and holders to have shortcomings. The present invention has been devised in the light of this appreciation.

According to a first aspect of the present invention, there is provided a toilet brush and holder, the toilet brush comprising a handle and a brush head, the holder comprising a container configured to hold disinfectant liquid, the holder being configured: to support the toilet brush and bear the weight of the toilet brush in a first position, in which the brush head is spaced apart from liquid in the container; and to support the toilet brush in a second position, in which the brush head is at least partially immersed in liquid in the container, the holder being configured for movement of the toilet brush between the first and second positions by a user.

After use, the toilet brush may be supported on the holder with the brush user moving the brush between the first and second positions, e.g. by moving the brush while gripping the handle. In the second position the brush head is at least partially immersed in the disinfectant liquid. In the first position the brush head is spaced apart from the disinfectant liquid and can thus dry, for example after immersion in the disinfectant liquid. According to known toilet brushes and holders, such as those of GB 510900 and DE 20201635, there is no provision of a position in which the weight of the toilet brush is supported by the holder while the toilet brush dries.

More specifically, the toilet brush and holder may comprise a biasing device, which is operative to urge the brush towards the first position. Thus, in the absence of a user applied force against the bias of the biasing device, the brush may remain in the first, drying position. Application of force against the bias may move the brush head into the second, immersed position.

More specifically, the toilet brush and holder may be configured such that the biasing device bears between the toilet brush and holder.

Alternatively or in addition, the biasing device may comprise at least one of: a spring; and a pneumatic piston.

Alternatively or in addition, the biasing device may be comprised in the toilet brush.

More specifically, the toilet brush and holder may be configured such that when the user applies a force to the brush handle to move between the first and second positions, the biasing device bears between the brush handle and the holder.

Alternatively or in addition, the toilet brush may comprise a flange configured to engage with the holder when the toilet brush is supported on the holder. Where a biasing device bears between the brush handle and the holder, a force may be coupled from the biasing device to the holder by the flange.

More specifically, the flange may be attached to the toilet brush and disposed on the brush at a location between the brush head and a grippable part of the handle. Thus, the flange may reduce the likelihood of fluid spraying onto or running down the handle to the user's hand during use of the brush.

Alternatively or in addition, the flange may define an aperture through which the brush handle passes during movement between the first and second positions.

Alternatively or in addition, the flange may define at least one aperture so as to provide for passage of air from within the holder when the toilet brush is supported on the holder. Thus, the at least one aperture can allow for escape of vapour formed from the disinfectant liquid which might otherwise build up within the holder.

Alternatively or in addition, the flange may support a sleeve, which extends into the holder when the toilet brush is supported on the holder, through which the handle passes.

More specifically, an end of the sleeve may engage the flange and an opposing end of the sleeve may support a first end of a biasing device, a second opposing end of the biasing device engaging a projection on the brush handle, the biasing device applying a bias when in the second position.

Alternatively or in addition, the holder may define an open ended space, the open end being enclosed by the flange.

Alternatively or in addition, the toilet brush and holder may be configured such that movement of the brush between the first and second positions is by movement of the brush along a longitudinal axis, the longitudinal axis being defined by the handle of the toilet brush.

More specifically, movement of the brush between the first and second positions may be substantially solely along the longitudinal axis.

Alternatively or in addition, the holder may define a generally cylindrical space.

Alternatively or in addition, the container may be defined by a lower portion of, for example a main body of, the holder.

Alternatively or in addition, the holder may comprise a removable stand that defines a ground engaging surface. In use the ground engaging surface may support the holder, e.g. on a floor.

More specifically, the stand may comprise a skirt, which, in use, extends around an outside of the holder.

More specifically, the skirt may define an aperture in which a portion, e.g. a lower portion, of the holder is received.

Alternatively or in addition, the skirt may engage with an outer surface of the holder substantially adjacent a top of a space in which the brush head is received.

More specifically, the outer surface adjacent the top of the space may define a shoulder against which the skirt abuts.

More specifically, the holder may narrow towards the lower portion to define a space that is substantially the same shape as the brush head.

Alternatively or in addition, a plurality of protrusions, such as ribs, may extend into the disinfectant receiving space defined by the container. The protrusions may provide for agitation of the brush head when the toilet brush is in the second position.

Alternatively or in addition, the holder may comprise a support arrangement configured to support the holder on a wall.

More specifically, the support arrangement may comprise an annular member which fits around the holder and bears the holder weight. An exterior surface of the holder may have a profile against which the annular member abuts.

Alternatively or in addition, the toilet brush and holder may comprise a disinfectant dispenser which is operable to apply disinfectant to a grippable part of the brush handle.

More specifically, the disinfectant dispenser may be disposed on the toilet brush and holder and may be operable to apply disinfectant when the brush is being moved between the first and second positions.

More specifically, the disinfectant dispenser may be disposed on a flange extending from the brush handle.

More specifically, the disinfectant dispenser may rest on the flange, the dispenser and the flange having interengaging profiles.

The interengaging profiles may restrict movement of the dispenser in relation to the flange. The interengaging profiles may, for example, comprise protrusions shaped to be received in respective apertures to restrict rotation of the dispenser and the flange in relation to each other about the brush handle.

Alternatively or in addition, the dispenser may define a space and may comprise an absorbent member received in the space. The absorbent member may hold disinfectant to be applied to the brush handle.

More specifically, the toilet brush and holder may be configured such that the absorbent member is urged against an exterior surface of the brush handle.

Alternatively or in addition, the absorbent member may define an aperture through which the brush handle passes.

Alternatively or in addition, the dispenser may have a generally annular form.

More specifically, the dispenser may comprise two arms hingedly attached to each other, the distal ends of the two arms abutting each other to form the annulus, the distal ends being rotatable apart from each other about a hinge. Thus, the dispenser may be removed from around the brush handle.

Alternatively or in addition, the toilet brush and holder may comprise an air-freshener dispenser, the air-freshener dispenser holding air-freshener and being operable to release a mass of air-freshener upon movement of the toilet brush between the first and second positions.

More specifically, the air-freshener dispenser may be operable to eject the mass of air-freshener upon movement of the toilet brush.

More specifically, the air-freshener dispenser may be configured to eject the mass of air-freshener in dependence upon positive air pressure created when the toilet brush moves between the first and second positions.

More specifically, the brush handle may define a space which receives air-freshener and which reduces in volume as the toilet brush moves between the first and second positions.

Alternatively or in addition, the air-freshener dispenser may be comprised in the brush handle. The air-freshener container may be removably received in the brush handle.

More specifically, the air-freshener dispenser may comprise an air-freshener container holding air-freshener, the air-freshener container being disposed within the brush handle.

Alternatively or in addition, the air-freshener dispenser may comprise a closing member closing an end of the brush handle opposing the end of the brush handle at which the brush head is disposed.

More specifically, the closing member may define at least one aperture through which, in use, air-freshener is ejected.

Alternatively or in addition, the closing member may be movable in relation to the brush handle, and the closing member may comprise a protruding member disposed on the closing member such that the protruding member breaches an air-freshener container a upon movement of the closing member in relation to the brush handle. Thus, the closing member may be a knob that threadedly engages with the brush handle and the protruding member may be a cutter extending into a space defined by the brush handle. Thus, where the space holds an air-freshener container have a frangible seal opposing the closing member the protruding member can break the frangible seal to allow the air-freshener in the container to be brought into use.

According to a second aspect of the present invention, there is provided a toilet brush and holder, the toilet brush having a brush handle and a brush head, the holder being configured to support the toilet brush, the toilet brush and holder comprising a disinfectant dispenser operable to apply disinfectant to a grippable surface of the brush handle when the toilet brush is moved in relation to the holder.

Embodiments of the second aspect of the present invention may comprise one or more features of the first aspect of the present invention.

According to a third aspect of the present invention there is provided a toilet brush and holder, the toilet brush having a handle and a brush head, the holder being configured to support the toilet brush, the toilet brush and holder comprising an air-freshener dispenser holding air-freshener and being operable to release a mass of air-freshener upon movement of the toilet brush in relation to the holder.

Embodiments of the third aspect of the present invention may comprise one or more features of the first aspect of the present invention.

BRIEF DESCRIPTION OF THE DRAWINGS

Further features and advantages of the present invention will become apparent from the following specific description, which is given by way of example only and with reference to the accompanying drawings, in which.

SPECIFIC DESCRIPTION

Figure 1B:
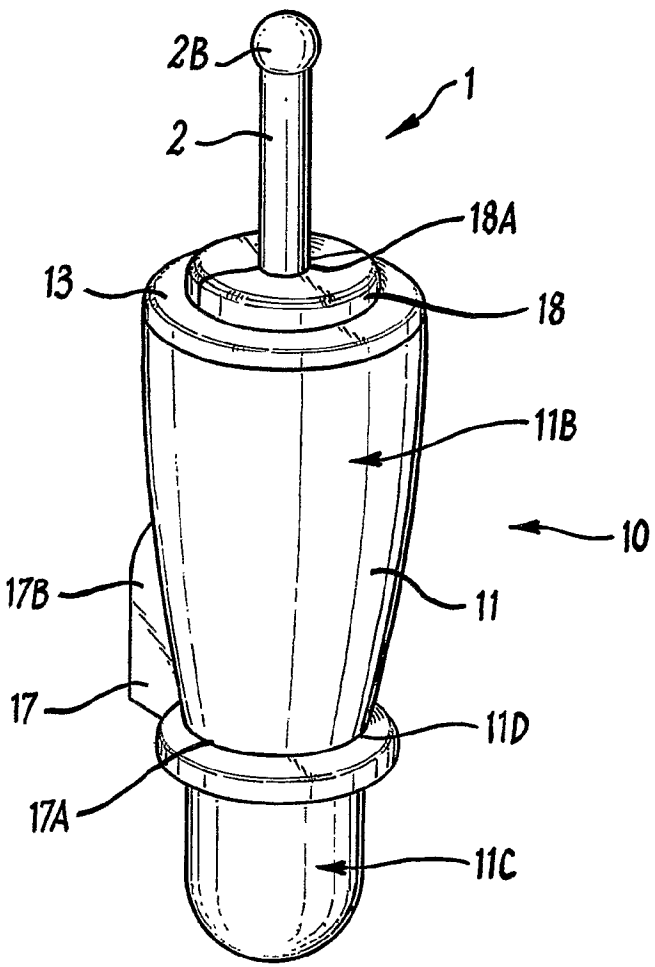
FIG. 1B shows a perspective view of the toilet brush and holder having a wall bracket.

Referring to the drawings there is shown a toilet brush 1 and holder 10.

Toilet brush 1 has a brush handle 2 and a dome-shaped brush head 3. Head 3 has an internal thread 3A which screws onto a threaded projection 2A at one end of the brush handle 2. A spherical cap 2B is provided at the other end of the brush handle 2.

The holder 10 includes a bowl 11 having an open end 11A. Bowl 11 has a widened upper cavity 11B which narrows to a chamber 11C (which constitutes a container) the internal shape of which is substantially the same size as the external shape of the brush head 3. The top of the bowl chamber 11C includes a peripheral shoulder 11D. Bowl chamber 11C receives disinfectant liquid. Bowl chamber 11C includes a plurality of vertical ribs 12 on its internal surface.

The toilet brush 1 is supported on the holder 10 is by a flange 13 which also provides a lid for an open end 11A of the bowl 11. The flange 13 has a central aperture 13A through which the brush handle 2 passes.

The flange 13 supports a sleeve 14, which extending into bowl cavity 11B when the toilet brush is supported on the holder, and through which the brush handle 2 slides. One end 14A of the sleeve engages an annular projection 13B on the underside of the flange 13. The other end 14B of the sleeve 14 supports one first end 15A of a coil spring 15 (which constitutes a biasing device). The second end 15B of the spring 15 engages an annular projection 2C on brush handle 2.

Figure 1A:
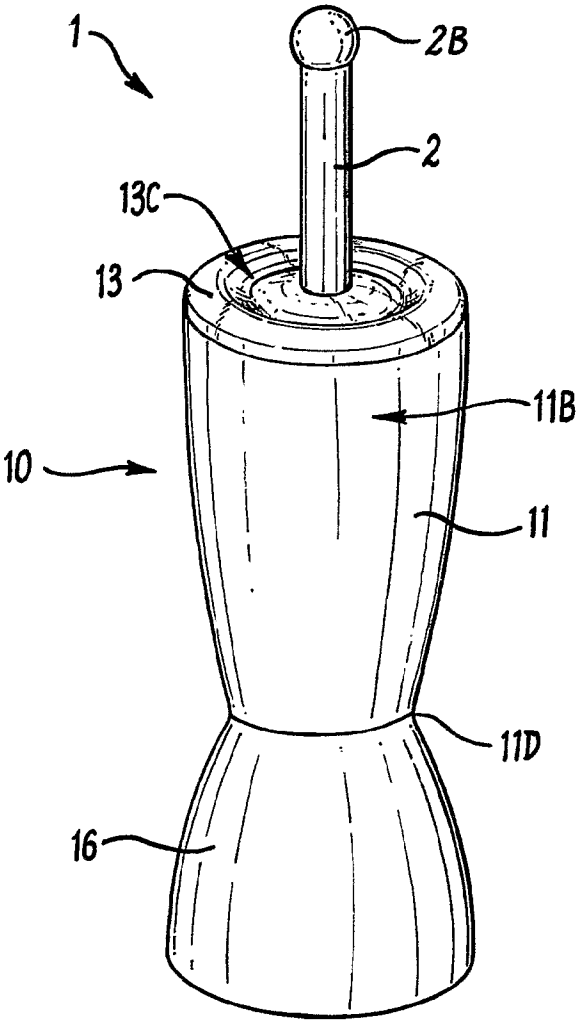
FIG. 1A shows a perspective view of the toilet brush and holder having a floor skirt.

As shown in FIG. 1A, the holder 10 includes a removable skirt 16 (which constitutes a removable stand) around the outside of the bowl to allow the holder to sit on a substantially flat surface such as the floor of a bathroom. The skirt 16 includes an aperture 16A to engage around the bowl adjacent the top of the bowl chamber 11 and to abut against shoulder 11D. The skirt 16 thus looks substantially integral with bowl 11. As shown in FIG. 1B, the holder 10 may also be wall mounted. The holder is mountable on a wall by means of a wall bracket 17 (which constitutes a support arrangement). The wall bracket includes an aperture 17A which engages around the bowl adjacent the top of the bowl chamber 11 and abuts against shoulder 11D. Wall bracket 17 has a flange 17B for securement to a wall (or other vertical surface such as a cabinet door).

Figure 2:
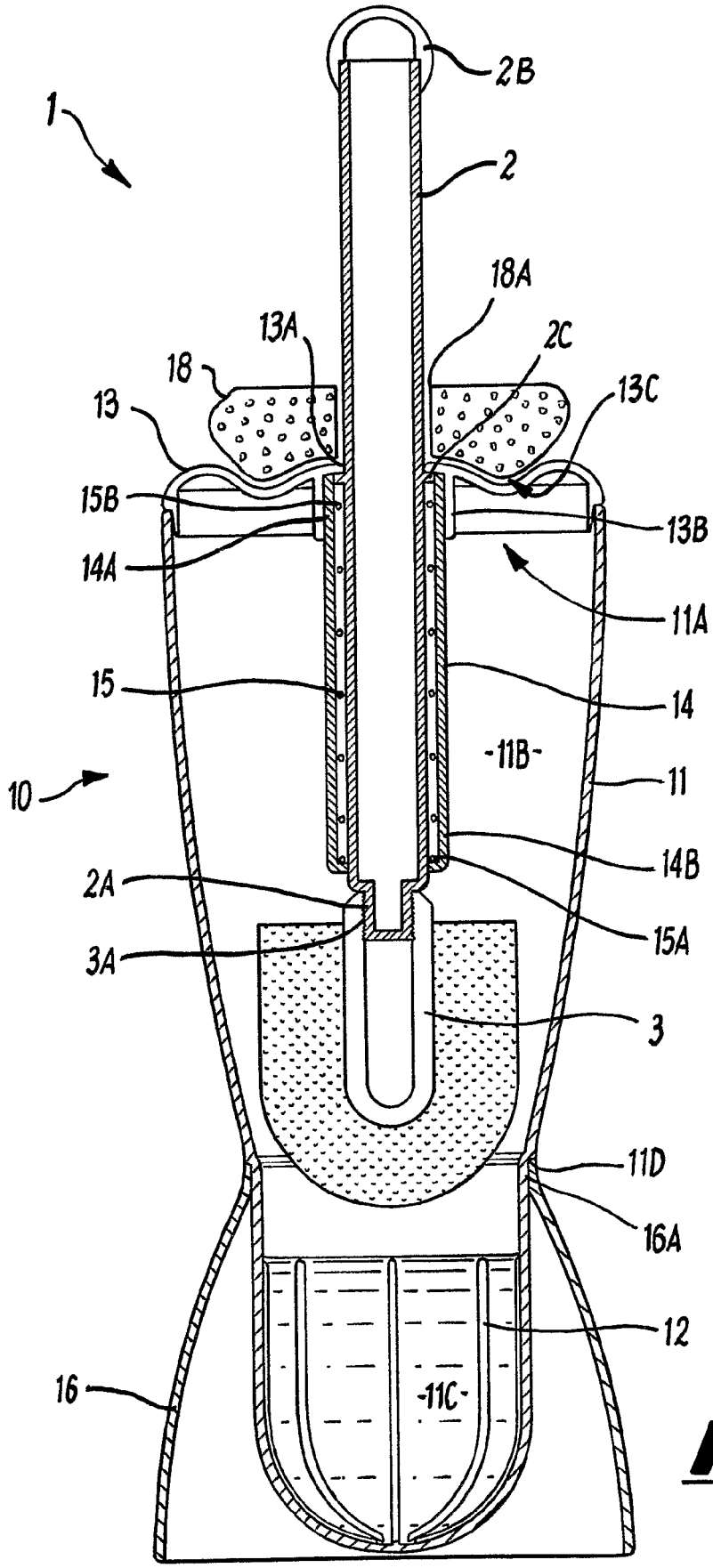
FIG. 2 shows a cross section view through the toilet brush and holder, with the brush in the first position.

In use, brush 1 is normally supported in a first position (as shown in FIG. 2) with the brush head 3 above the liquid in the bowl chamber 11C where it can "drip-dry" itself. Brush 1 can be taken off the holder 10 and used to clean a toilet and then replaced on the holder 10.

Figure 3:
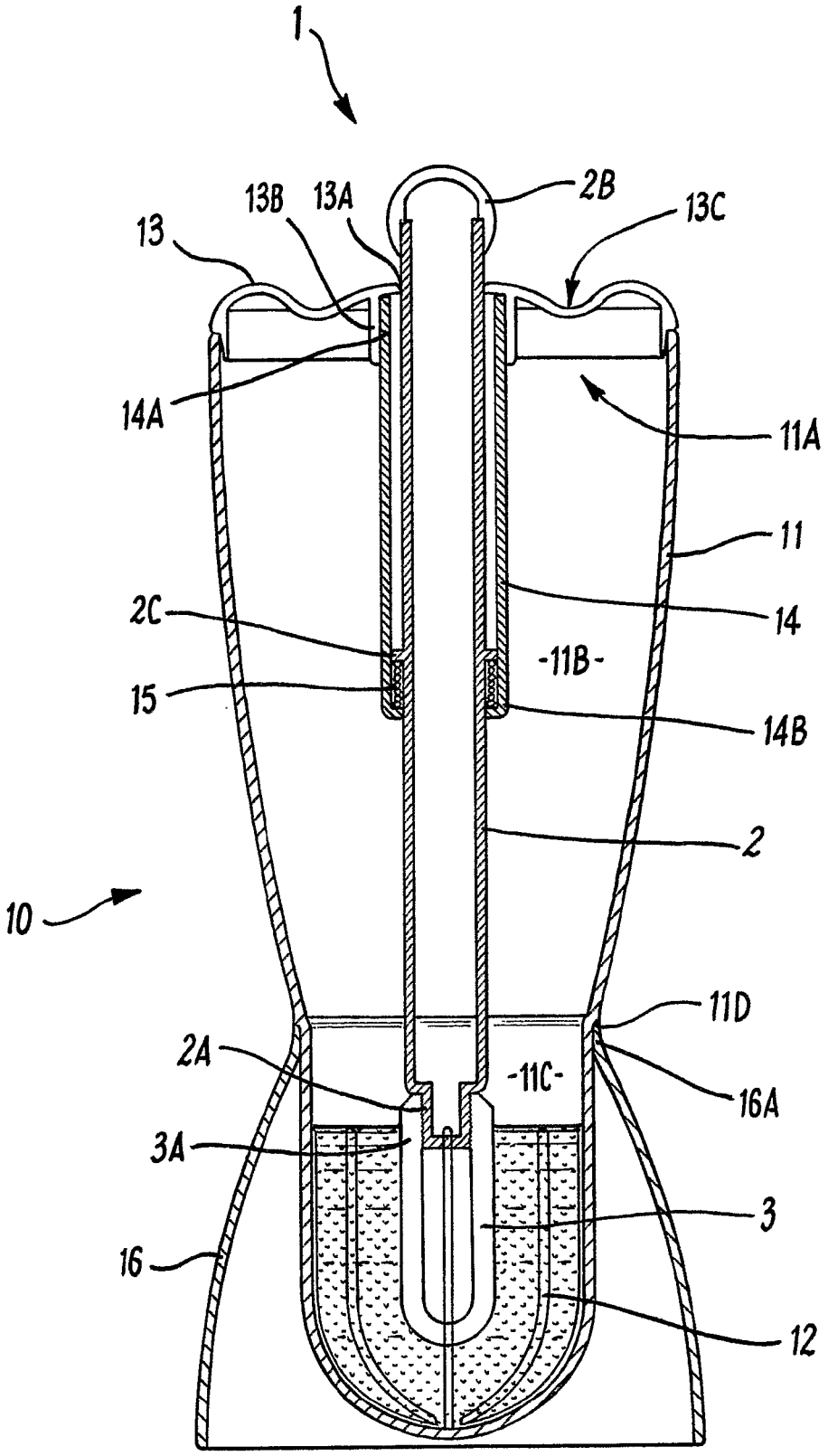
FIG. 3 shows a cross section view through the toilet brush and holder, with the brush in the second position.

In order to then clean the brush head 3, brush handle 2 is pushed down manually to compress spring 15 so that the brush is in a second position (as shown in FIG. 3) with the brush head in the liquid chamber 11C so it is disinfected by the liquid. The brush handle can then be released and the spring 15 biases the brush back into the first position (as shown in FIG. 2). The brush head 3 is again above the liquid in the bowl chamber 11C where it can "drip-dry" itself.

When in the second position, the brush 1 can be rotated whereby the brush head surface can be agitated by the ribs 12 to further clean the brush head surface.

Figure 4:
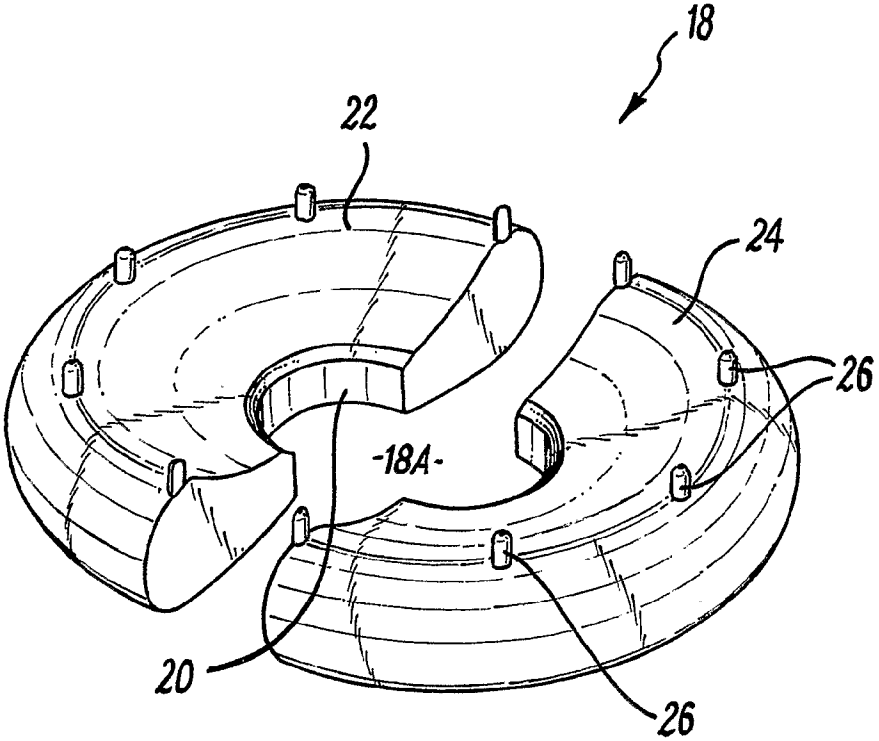
FIG. 4 is a perspective view of the ring.

Flange 13 includes an annular recess 13C to receive a ring 18 (shown in FIGS. 1B and 2 only) to engage around the brush handle 2. A perspective view 30 of the ring 18 is shown in FIG. 4. Ring 18 has a central aperture 18A through which the handle can slide. Ring 18 has absorbent material 20 holding disinfectant to disinfect the handle when the handle slides through the ring as the brush moves from the first to the second position and vice versa. The ring 18 is formed from two semicircular components 22, 24 hinged together (not shown) in order to remove and place the ring around the brush handle 2. Ring 18, charged with disinfectant, may be sold as a disposable which needs replacement from time to time as the disinfectant held in the absorbent material is exhausted. As sold, the exposed part of the absorbent material 20 is covered with a removable film of plastics material, which is peeled off before the ring is brought into use. The removable film of plastics material reduces evaporation of disinfectant held in the absorbent material 20, e.g. during storage of the ring before sale. The ring is provided with protrusions 26 spaced apart around one side. In use of the ring, each protrusion 26 is received in a respective aperture (note shown) formed in the flange 13. Apertures formed in the flange also serve to allow for escape of vapour that may build up inside the holder 10.

Figure 5:
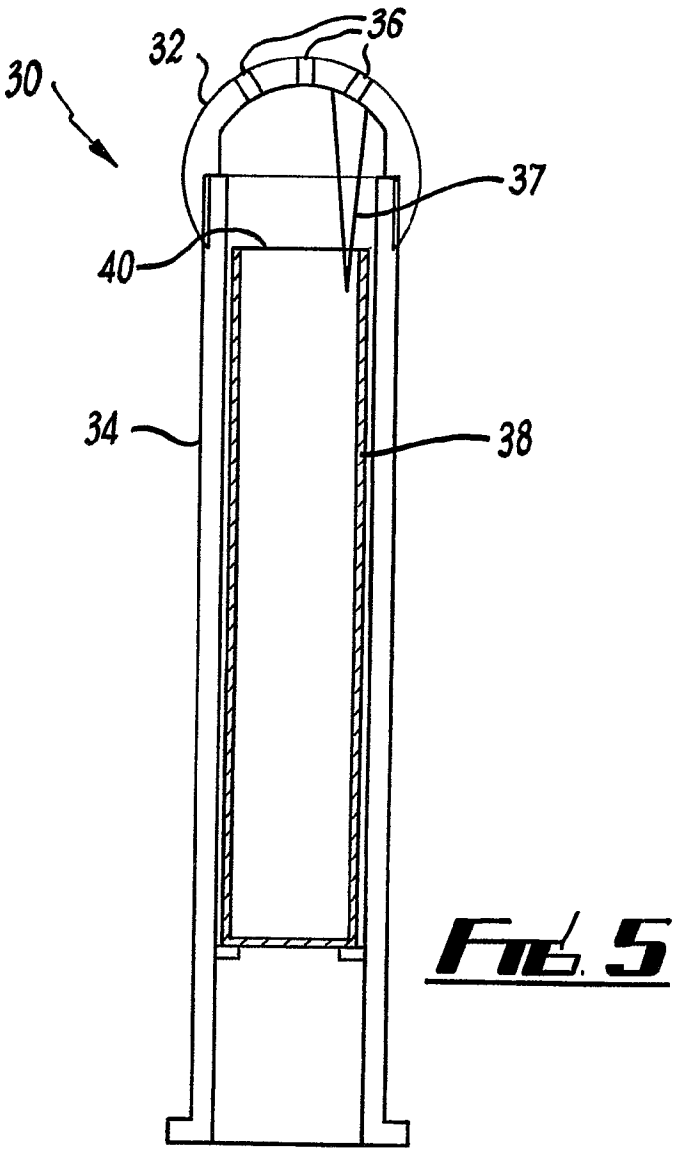
FIG. 5 shows the air-freshener dispenser of the present invention.

FIG. 5 shows is air-freshener dispenser 30, which comprises a knob 32 that is threadedly received on the end of the toilet brush 34 opposing the end bearing the brush head. The knob defines a plurality of apertures 36. The knob also comprises a cutter 37 extending into a space defined by the toilet brush 34. An air-freshener container 38 is held within the space defined by the toilet brush 34. The air-freshener container 38 holds air-freshener in an appropriate form, such as a gel or paste. An upper end 40 of the air-freshener container 38 is provided with a film of plastics material which prevents evaporation of air-freshener from the container. The air-freshener container 38 would be sold with the film of plastics material intact. The air-freshener container 38 is brought into use by rotating the knob 32 relative to the toilet brush 34 so that the cutter 37 breaks the film of plastics material to allow evaporated air-freshener to diffuse into the space above the air-freshener container 38. Movement of the toilet brush from the second, depressed position to the first, drying position reduces the volume of the space between the air-freshener container 38 and the knob 32 forcing air bearing evaporated air-freshener through the apertures 36 and into the environment around the toilet brush holder.

Component parts of the toilet brush and holder are formed of a rigid plastics material, such as polypropylene.

The disinfectant liquid provided in the bowl chamber 11C is a 5 gram AntiBak tablet dissolved in 250 ml of water. AntiBak is bactericidal, sporocidal, virucidal, tuberculocidal and fungicidal and therefore classed as a broad spectrum disinfectant. AntiBak tablets are manufactured by Bio Technics Limited, Uppermill, Inverbervie, Aberdeenshire, Scotland, UK, DD10 0SP.

Alternatively and under certain circumstances, the disinfectant liquid provided in the bowl chamber 11C is a 3.5 gram NaDDC tablet dissolved in 250 ml of water. 3.5 gram NaDDC tablets are provided by Hydrachem Limited of Billingshurst, Sussex, England, RH14 9EZ.

The disinfectant held in the absorbent material of the ring 18 is biological disinfectant called Enduro. Enduro is 99.999% effective against MRSA, *E. coli* (0157), *Salmonella enteritdis* and *C. difficile* (vegetative) and s UK DEFRA Approved for HSN1 Avian Flu. Enduro is manufactured by Bio Technics Limited, Uppermill, Inverbervie, Aberdeenshire, Scotland, UK DD10 0SP Alternatively and under certain circumstances, disinfectant held in the absorbent material of the ring 18 is an alcohol based disinfectant of a kind commonly used for disinfection purposes.

The air-freshener contained in the air-freshener is of a type to be found in any one of a number of well known house-hold air-fresheners.

What is claimed is:

1. A toilet brush and holder, the toilet brush comprising a handle and a brush head, the holder comprising a container configured to hold disinfectant liquid in which a plurality of protrusions extend into a disinfectant receiving space defined by the container, the holder being configured: to support the toilet brush and bear the weight of the toilet brush in a first position, in which the brush head is spaced apart from liquid in the container; and to support the toilet brush in a second position, in which the brush head is at least partially immersed in liquid in the container, the holder being configured for movement of the toilet brush between the first and second positions by a user, the toilet brush and holder comprising a biasing device, which is operative to urge the brush towards the first position, the biasing device being comprised in the toilet brush.

2. A toilet brush and holder according to claim 1, in which the toilet brush and holder are configured such that the biasing device bears between the toilet brush and holder.

3. A toilet brush and holder according to claim 1, in which the biasing device comprises at least one of: a spring; and a pneumatic piston.

4. A toilet brush and holder according to claim 1, in which the toilet brush and holder are configured such that when the user applies a force to the brush handle to move between the first and second positions, the biasing device bears between the brush handle and the holder.

5. A toilet brush and holder according to claim 1, in which the toilet brush comprises a flange configured to engage with the holder when the toilet brush is supported on the holder.

6. A toilet brush and holder according to claim 5, in which the flange is attached to the toilet brush and disposed on the brush at a location between the brush head and a grippable part of the handle.

7. A toilet brush and holder according to claim 5, in which the flange defines an aperture through which the brush handle passes during movement between the first and second positions.

8. A toilet brush and holder according to claim 5, in which the flange defines at least one aperture so as to provide for passage of air from within the holder when the toilet brush is supported on the holder.

9. A toilet brush and holder according to claim 5, in which the flange supports a sleeve, which extends into the holder when the toilet brush is supported on the holder, through which the handle passes.

10. A toilet brush and holder, the toilet brush comprising a handle and a brush head, the holder comprising a container configured to hold disinfectant liquid, the holder being configured: to support the toilet brush and bear the weight of the toilet brush in a first position, in which the brush head is spaced apart from liquid in the container; and to support the toilet brush in a second position, in which the brush head is at least partially immersed in liquid in the container, the holder being configured for movement of the toilet brush between the first and second positions by a user, the toilet brush and holder comprising a biasing device, which is operative to urge the brush towards the first position, the biasing device being comprised in the toilet brush, in which the toilet brush comprises a flange configured to engage with the holder when the toilet brush is supported on the holder, in which the flange supports a sleeve, which extends into the holder when the toilet brush is supported on the holder, through which the handle passes, in which an end of the sleeve engages the flange and an opposing end of the sleeve supports a first end of the biasing device, a second opposing end of the biasing device engaging a projection on the brush handle, the biasing device applying a bias when in the second position.

11. A toilet brush and holder according to claim 5, in which the holder defines an open ended space, the open end being enclosed by the flange.

12. A toilet brush and holder according to claim 1, in which the toilet brush and holder are configured such that movement of the toilet brush between the first and second positions is by movement of the toilet brush along a longitudinal axis, the longitudinal axis being defined by the handle of the toilet brush.

13. A toilet brush and holder according to claim 12, in which movement of the toilet brush between the first and second positions is substantially solely along the longitudinal axis.

14. A toilet brush and holder according to claim 1, in which the container is defined by a lower portion of the holder.

15. A toilet brush and holder, the toilet brush comprising a handle and a brush head, the holder comprising a container configured to hold disinfectant liquid, the holder being configured: to support the toilet brush and bear the weight of the toilet brush in a first position, in which the brush head is spaced apart from liquid in the container; and to support the toilet brush in a second position, in which the brush head is at least partially immersed in liquid in the container, the holder being configured for movement of the toilet brush between the first and second positions by a user, the toilet brush and holder comprising a biasing device, which is operative to urge the brush towards the first position, the biasing device being comprised in the toilet brush, in which the toilet brush and holder comprises a disinfectant dispenser which is operable to apply disinfectant to a grippable part of the brush handle.

16. A toilet brush and holder according to claim 15, in which the disinfectant dispenser is disposed on the toilet brush and holder and is operable to apply disinfectant when the brush is being moved between the first and second positions.

17. A toilet brush and holder according to claim 16, in which the disinfectant dispenser is disposed on a flange extending from the brush handle.

18. A toilet brush and holder according to claim 15, in which the dispenser defines a space and comprises an absorbent member received in the space that in use holds disinfectant to be applied to the brush handle.

19. A toilet brush and holder according to claim 18, in which the toilet brush and holder is configured such that the absorbent member is urged against an exterior surface of the brush handle.

* * * * *